United States Patent [19]

Jackson et al.

[11] 4,441,857

[45] Apr. 10, 1984

[54] WEAR RESISTANT FAN BLADE FOR CENTRIFUGAL FAN

[75] Inventors: John E. Jackson, Brownsburg; William G. Doherty, Lebanon, both of Ind.

[73] Assignee: Union Carbide Corporation, Danbury, Conn.

[21] Appl. No.: 305,728

[22] Filed: Sep. 25, 1981

[51] Int. Cl.[3] ..... F04D 29/02

[52] U.S. Cl. ..... 415/213 R; 416/223 B; 416/224; 416/236 R

[58] Field of Search ..... 415/213 R; 416/224, 416/235, 236 R, 237

[56] References Cited

U.S. PATENT DOCUMENTS 265,984 10/1882 Schmolz ..... 416/235 X 933,151 9/1909 Amnelius ..... 416/235

2,653,755 9/1953 Kruhmin ..... 416/224 X 3,608,976 9/1971 Zugelder ..... 416/236 X

FOREIGN PATENT DOCUMENTS 255778 11/1927 Italy ..... 416/235

*Primary Examiner*—Harvey C. Hornsby

*Assistant Examiner*—Arthur D. Dahlberg

*Attorney, Agent, or Firm*—John R. Doherty; Harrie M. Humphreys

[57] ABSTRACT

In a centrifugal fan having radially directed fan blades, each having, in combination, a serrated surface forming in longitudinal cross-section a sawtooth configuration in the radial direction of the rotating blade with a wear resistant coating over a substantial area of the serrated surface.

10 Claims, 5 Drawing Figures

WEAR RESISTANT FAN BLADE FOR CENTRIFUGAL FAN

This invention relates to impeller blades for use in centrifugal fans operating with air containing erosive media.

Radial flow fans used in industrial applications for exhausting gas stream effluents containing abrasive particles cause erosion and rapid wear of the exhauster fan blades. Failure of a fan blade causes serious and sometimes destructive damage of the fan. Boilers fired with coal, for example, must contend with wear caused by the fuel itself as well as the residual ash. In some installations, a mixture of ground coal and air is blown into the boiler during the firing process. In other installations, it is necessary to have fans between the boiler exit and the associated pollution control equipment to provide the necessary draft. In both instances the fan components are rapidly worn by erosion from the solids suspended in the air stream. In other industries, such as iron ore benefaction, cement, mining, etc. maintenance of air handling equipment is a major expense because of fan wear.

Fan blade wear problems have been addressed in the past from the perspective of the wear properties of the steel compostion of the fan blade and from the application of wear resistance surface coatings. The use of wear resistant coatings on fan blade are known to increase fan blade life, reduce maintenance costs and to extend the times between blade replacement. The latter factor is an important one for electrical utilities who want to maintain high availability from their generating stations.

It has been discovered in accordance with the present invention that the longevity of a fan blade can be further increased by constructing the fan blade with a surface geometry that reduces the relative velocity of the erosive particles that contact the blade and modifies the angle of impingement of the particles on the blade surface. The increase in longevity and service life attributable to the use of a fan blade having a surface geometry in accordance with the present invention is further enhanced when combined with a wear resistant coating. Any conventional wear resistant coating composition may be applied using any conventional coating process although the method for forming hard wear resistant coatings on metallic substrates as disclosed in U.S. Pat. No. 4,163,071 is preferred, the disclosure of which is herein incorporated by reference. In accordance with the present invention, it is the combination of a fan blade with a wear resistant coating and a predetermined surface geometry which imparts a very long life to the fan blade.

Accordingly, it is the principal object of the present invention to provide a fan blade for a radial flow fan having a wear resistant coating and surface geometry for imparting increased service life to the fan blade.

Other objects and advantages of the present invention will become apparent from the following detailed description of the invention when read in conjunction with the accompanying drawings of which:

Figure 1:
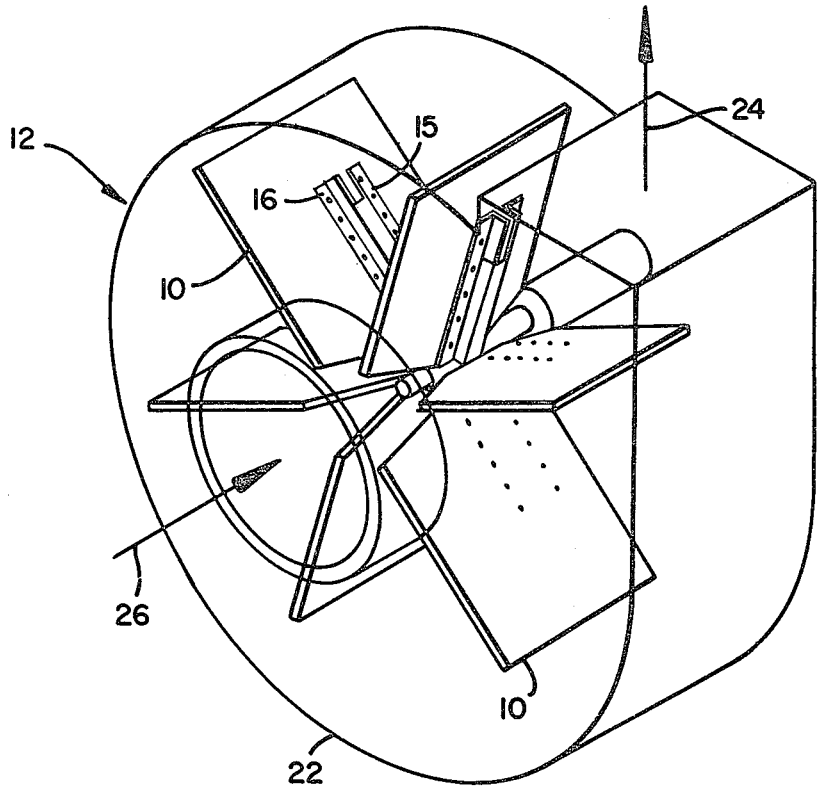
FIG. 1 is a diagrammatic illustration of a typical centrifugal fan having a plurality of radially arranged fan blades each of which has a surface configuration in accordance with the present invention.
Figure 2:
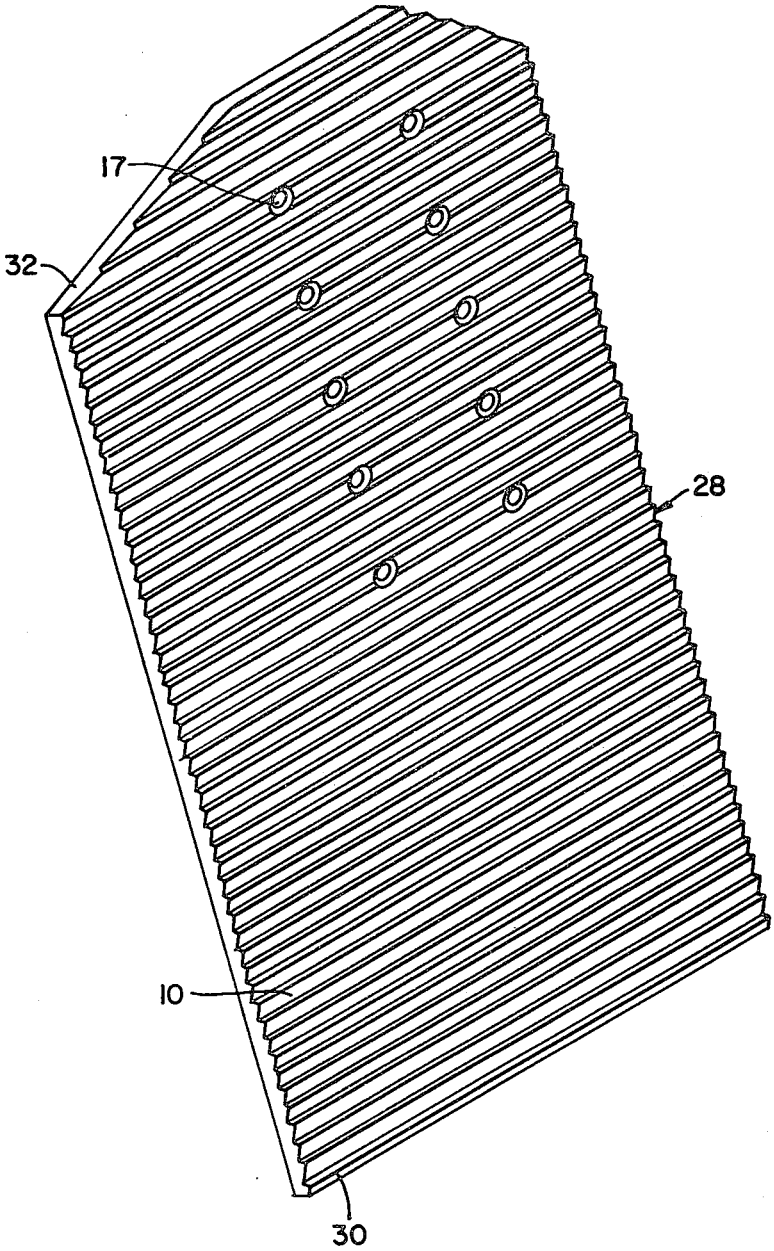
FIG. 2 is a plan view of an individual blade from the assembly of FIG. 1.
Figure 3:
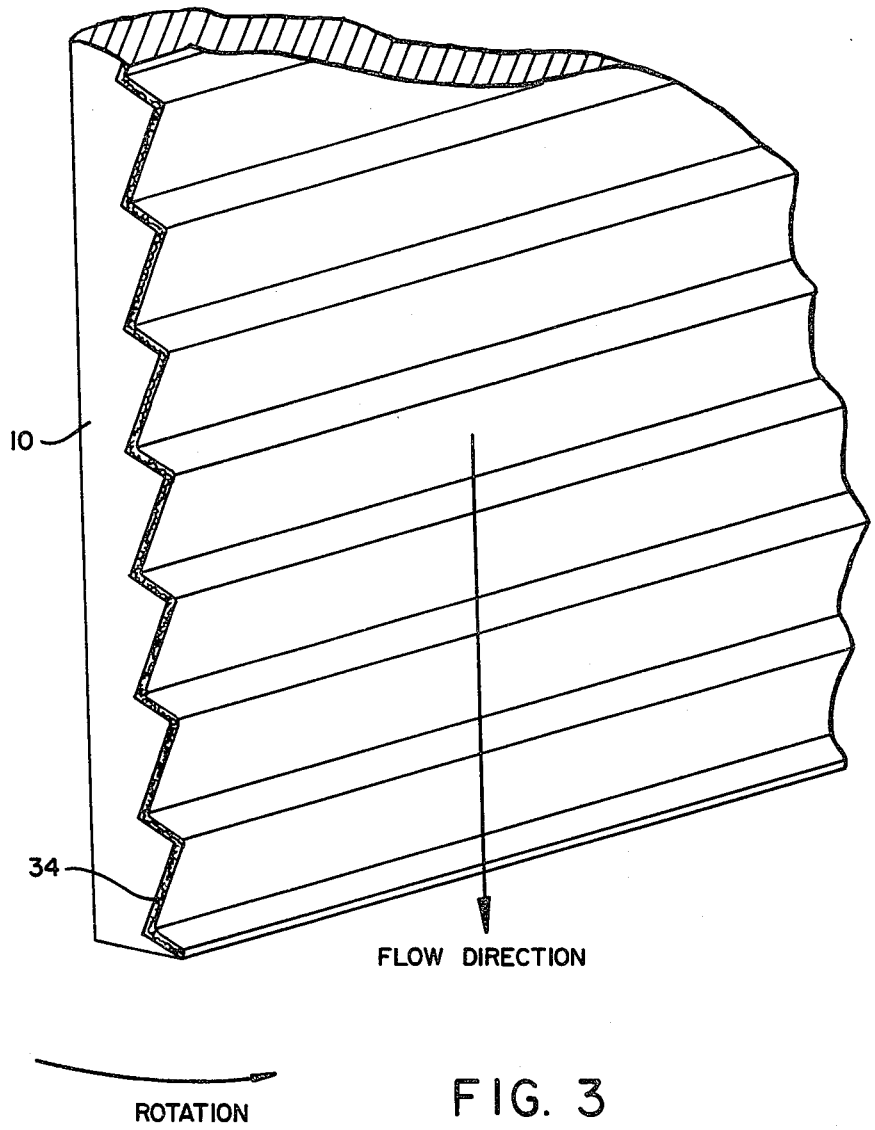
FIG. 3 is an exploded view in perspective of a section of the blade of FIG. 2.

Referring now to FIGS. 1–4 in which the fan blade 10 of the present invention is shown assembled in a centrifugal fan 12 of conventional paddle wheel design. A multiple number of fan blades 10 radially extend from a rotatable shaft 14 with each blade 10 supported by a bracket arm 15 affixed to the blade 10 by bolts 16 extending through bolt holes 17. The shaft 14 can be driven in any conventional fashion such as through a belt 18 driven in turn by a motor (not shown). The paddle wheel arrangement of fan blades 10 are enclosed in a housing 22 having an exhaust opening 24 and a single inlet opening 26. The inlet opening 26 directs the entering air in a direction parallel to the longitudinal axis of the shaft 14 whereupon the air is turned approximately ninety degrees in response to the pressure field differential developed by the spinning blades 10 as is well known in the art. The air effluent as it makes an approximately ninety degree turn is accelerated in velocity and directed radially outward. The air effluent leaves the fan with a velocity component that is comparable to the velocity at the exit tip 30 of the blade 10. With particulate laden air, the motion of the air and the blades 10 result in particles impinging upon the blades and then sliding toward their tips 30 where they are discharged. The impingement and sliding action of the erosive particles is believed responsible for the wear of the blade. Although the invention is described with reference to a centrifugal fan of flat radial paddle wheel design it is equally applicable to forward and backward inclined fan blade arrangements and to fans containing air foil shapes.

Figure 4:
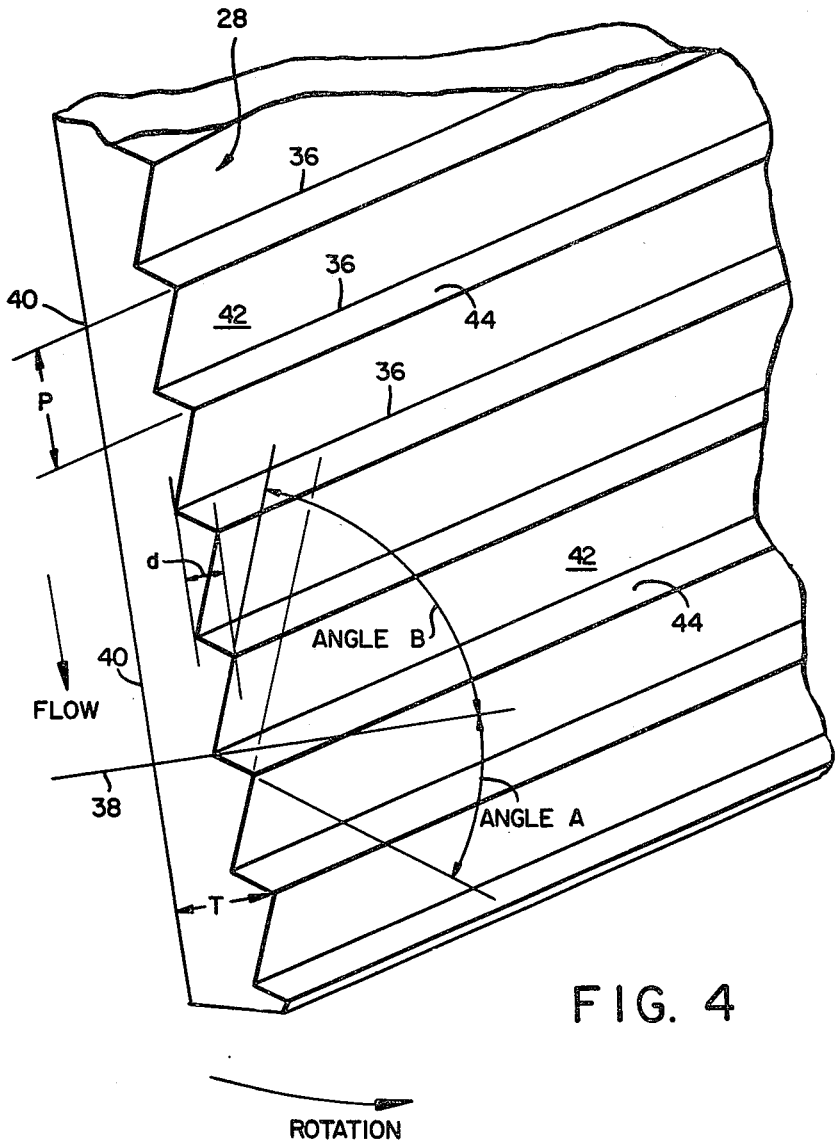
FIG. 4 is another view of the section of blade of FIG. 3 for illustrating the surface orientation between the inlet surface and exit surface of the serrated teeth.
Figure 5:
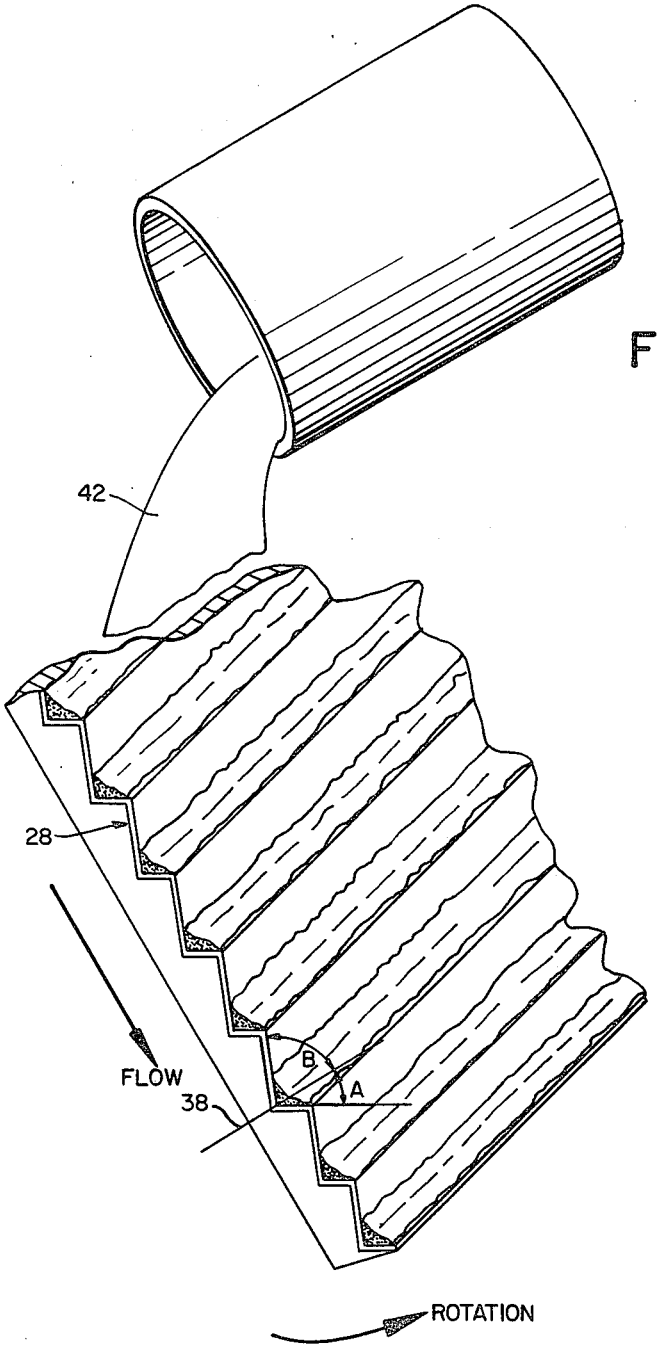
FIG. 5 is a diagrammatic test procedure for evaluating the performance of a serrated blade geometry.

The fan blades 10 of the present invention each have a serrated surface geometry 28 forming in longitudinal cross-section a sawtooth configuration in the radial direction of the rotating blade and extending from substantially the exit tip 30 of each blade 10 to substantially the inlet end 32 where they are joined to the support arms 15. The serration pitch "P" may range from being substantially equal to the depth "d" of the serrations 28 to substantially four times the depth "d". The number of serrated teeth should be in the order of between 2 to 10 to the inch with an optimum range of between 4 to 8 to the inch. FIG. 4 shows the preferred serrated sawtooth pattern. The depth "d" of the serrations 28 should be greater than the thickness of the wear resistant coating 34 and should preferably range between 1/32 and ½ inch. A depth greater than ½ inch will not increase the wear resistance performance but will increase the mass or weight of the blade. The blade thickness "T" should be at least about twice as thick as the depth "d" of the serrations 28. The notched apex 36 formed by each serrated toothe 28 should intersect a line 38 drawn normal to the back edge 40 of the blade 10 for forming an inlet angle B with the inlet surface 42 of each serrated tooth 28 and an exit angle A with the exit surface 44 of each serrated tooth. The inlet angle B should be greater than 45 degrees whereas the exit angle A should be less than 45°. The combined angle of angle A and angle B should lie between sixty and one hundred and twenty degrees. FIG. 5 illustrates a diagrammatic test procedure for establishing the desired angles for angle A and B respectively. The blade is shown standing with the exit end in a nearly vertical position so that angle B represents the entering angle for an erosive medium 42 dispensed onto the sawtooth surface while angle A represents the angle of exit. If the serrations 28 retain a reasonable amount of dispensed material then good wear performance is anticipated.

The blades 10 should preferably be flat although a reasonable degree of curvature is acceptable forming either a forward or backward curve from the tip 30 of the blade 10 relative to the direction of blade travel.

The wear resistant coating 34 over the blades is necessary to achieve the beneficial increase in service life. However, the coating 34 need only be applied over the serrated surface area which from experience is susceptible to the most wear. This generally will extend from about the exit tip toward the inlet end representing from sixty to 100 percent of the total surface area of the blade. An uncoated blade having the preferred serrated surface geometry will decrease the initial wear rate but will result in tooth wear readily transforming such surface to that of an equivalent flat blade. Accordingly, only so much of the blade surface that experiences rapid wear need also have a serrated surface geometry. However, from the perspective of manufacturing ease and practicality substantially the entire surface of the blade from the exit tip toward the inlet end should be serrated with a substantial portion of the serrated surface covered with a wear resistant coating. Any known wear resistant coating is acceptable although the coating hardness should be greater than 900 Hv. A preferred coating process for a fan blade constructed of low carbon steel or high strength-low alloy steels is taught in U.S. Pat. No. 4,163,071 entitled "Method for Forming Hard Wear Resistant Coatings". The preferred wear resistant coatings as taught in the patent are deposited by the plasma or detonation gun process and result in forming a metal matrix upon the blade surface taken from the class consisting of at least one of iron, nickel, cobalt and alloys thereof with a fine uniform dispersion of carbide particles taken from the class of carbides consisting of at least one of chromium, tungsten, tantalum, silicon, niobium, molybdenum, vanadium, titanium zirconium and hafnium.

What is claimed is:

1. A fan blade for use in exhausting a gas stream effluent containing erosive particles from a radial flow fan comprising, in combination, a serrated surface forming in longitudinal cross-section a sawtooth configuration in the radial direction of the rotating blade with each serration having a notched apex which intersects a line drawn normal to the back edge of the blade for forming an inlet angle with the inlet surface of the serration and an exit angle with the exit surface of the serration with the combined included angle between the inlet surface and the exit surface lying between sixty and one hundred and twenty degrees and oriented so as to trap erosive particles in the serrations with the serrated surface extending from substantially about the exit tip of the blade toward the inlet end thereof and having a wear resistant coating over at least a substantial area of the serrated surface.

2. A fan blade as defined in claim 1 wherein the number of serrated teeth is in the order of 2 to 10 to the inch.

3. A fan blade as defined in claim 2 wherein the number of serrated teeth is in the order of 4 to 8 to the inch.

4. A fan blade as defined in claim 3 wherein the serrated pitch "P" is in a range from substantially equal to the depth "d" of the serrations to that of substantially four times the depth.

5. A fan blade as defined in claim 4 wherein the depth of the serrations is greater than the thickness of the wear resistant coating.

6. A fan blade as defined in claim 5 wherein the depth of the serrations range from 1/32 to ½ inch.

7. A fan blade as defined in claim 6 wherein the blade thickness is equal to a thickness of at least about twice the depth of the serrations.

8. A fan blade as defined in claims 2 or 7 wherein the inlet angle should be greater than 45 degrees and wherein the exit angle should be less than 45 degrees.

9. A fan blade as defined in claim 8 wherein said blade is relatively flat.

10. A centrifugal fan having a rotating shaft, a plurality of fan blades radially extending from said shaft, means for rotating said shaft and an inlet and exit opening to said fan, wherein each of said fan blades includes, in combination, a serrated surface forming in longitudinal cross-section a sawtooth configuration in the radial direction of the rotating blade with each serration having a notched apex which intersects a line drawn normal to the back edge of the blade for forming an inlet angle with the inlet surface of the serration and an exit angle with the exit surface of the serration with the combined included angle between the inlet surface and the exit surface lying between sixty and one hundred and twenty degrees and oriented so as to trap erosive particles in the serrations with the serrated surface extending from about the exit tip of the blade toward the inlet end thereof and having a wear resistant coating over at least a substantial area of the serrated surface.

* * * * *